US005848442A

United States Patent [19]

Denzin

[11] Patent Number: 5,848,442

[45] Date of Patent: Dec. 15, 1998

[54] FLUSH VALVE ATTACHMENT SYSTEM

[75] Inventor: Peter W. Denzin, Glenbeulah, Wis.

[73] Assignee: Kohler Co., Kohler, Wis.

[21] Appl. No.: 964,957

[22] Filed: Nov. 5, 1997

[51] Int. Cl.[6] ..... E03D 1/35

[52] U.S. Cl. ..... 4/395; 4/393

[58] Field of Search ..... 4/329, 392, 393, 4/395, 397, 403, 404, 330, 331

[56] References Cited

U.S. PATENT DOCUMENTS

| | | | |
|---|---|---|---|
| 2,016,635 | 10/1935 | Henn | 4/393 |
| 2,741,774 | 4/1956 | Gibbons | 4/393 |
| 2,744,258 | 5/1956 | Harkness | 4/52 |
| 2,776,437 | 1/1957 | Detjen | 4/393 |
| 2,810,915 | 10/1957 | Zinkil | 4/393 |
| 2,876,458 | 3/1959 | Schmidt et al. | 4/393 |
| 3,702,012 | 11/1972 | Bennett | 4/392 |
| 4,433,446 | 2/1984 | Grimstad | 4/378 |
| 4,835,797 | 6/1989 | Castelii | 4/332 |

*Primary Examiner*—David J. Walczak
*Attorney, Agent, or Firm*—Quarles & Brady

[57] ABSTRACT

A flush valve is connectable to a vertical wall of a toilet tank. An overflow tubular member is in fluid communication with the flush valve housing and there are clip members mounted on the overflow member for connection with a flapper valve. In a preferred manner, the clip members are mounted on the back side of the overflow member whereby the overflow member acts as a guide, as well as a stop for the flapper valve.

9 Claims, 3 Drawing Sheets

FIG. 1
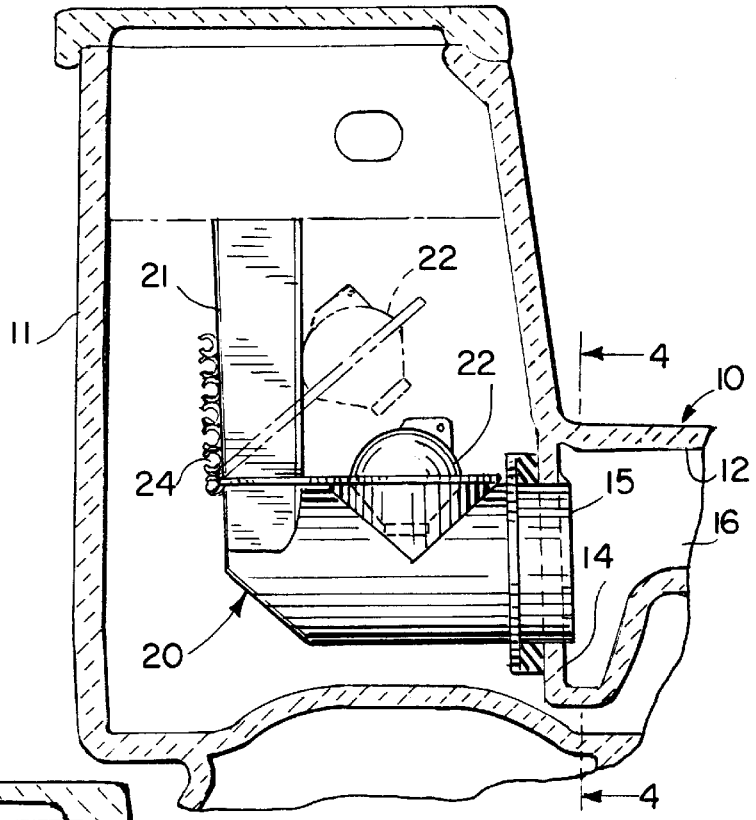
FIG. 9
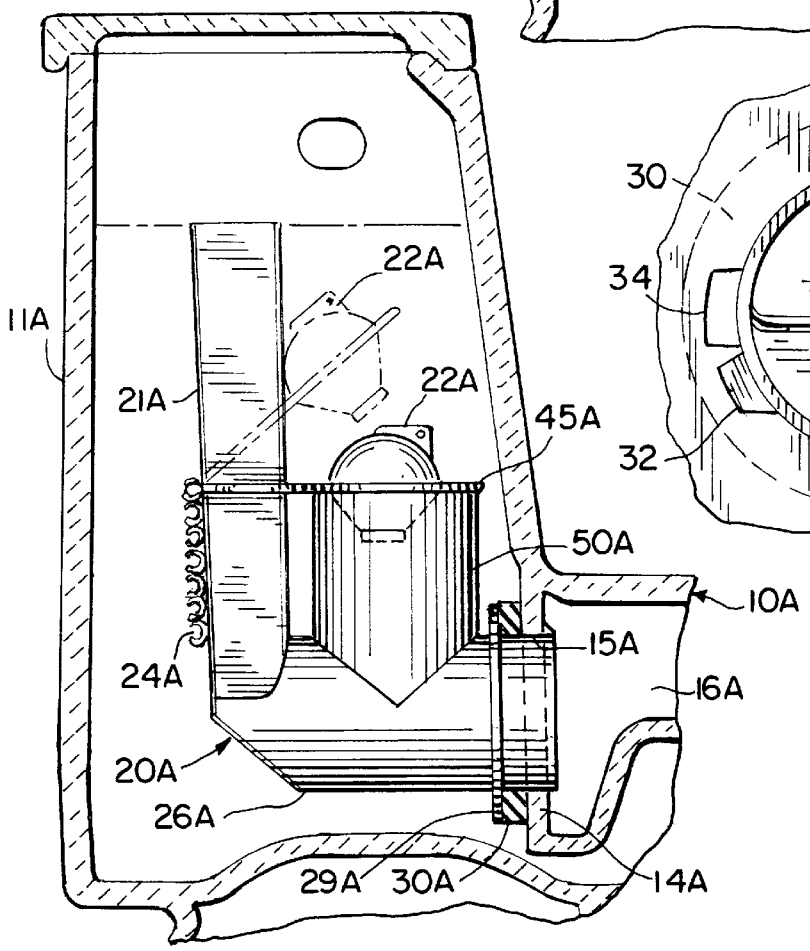
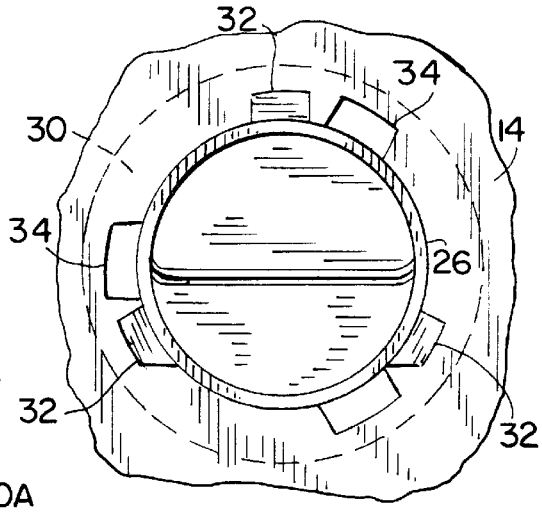
FIG. 4

FIG. 5
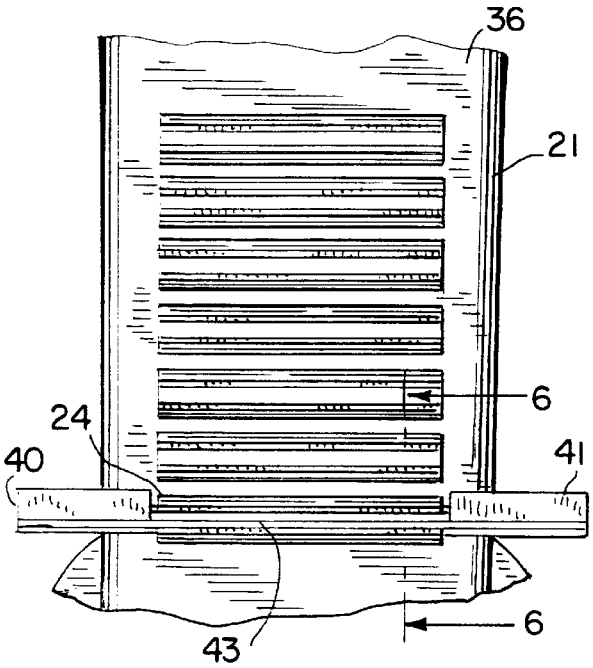
FIG. 6
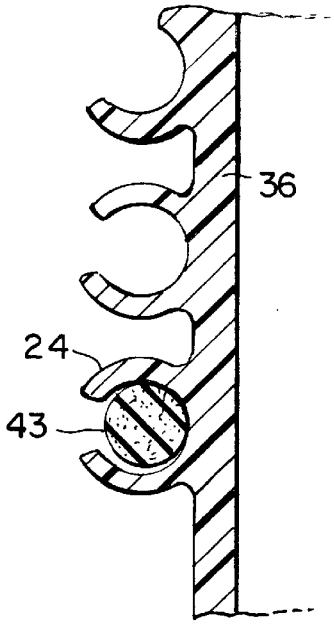
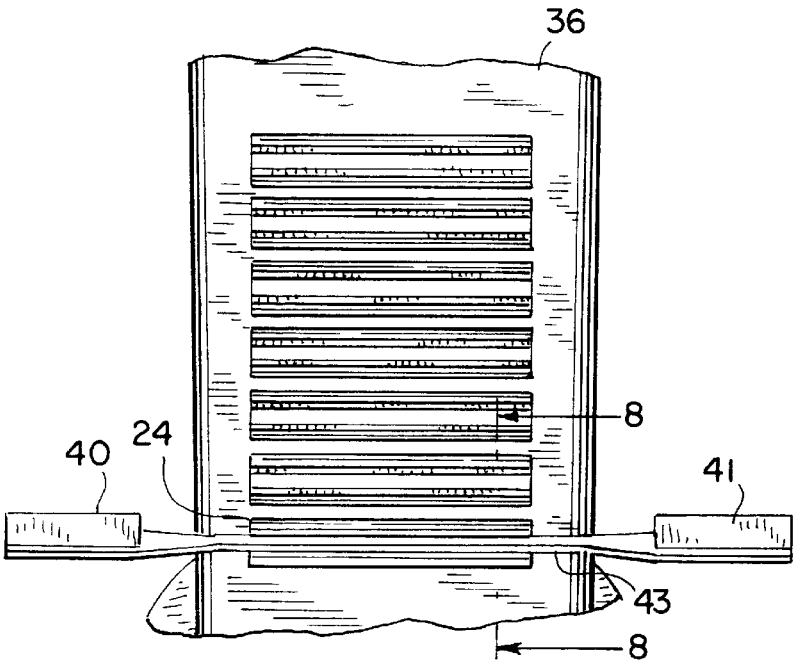
FIG. 7
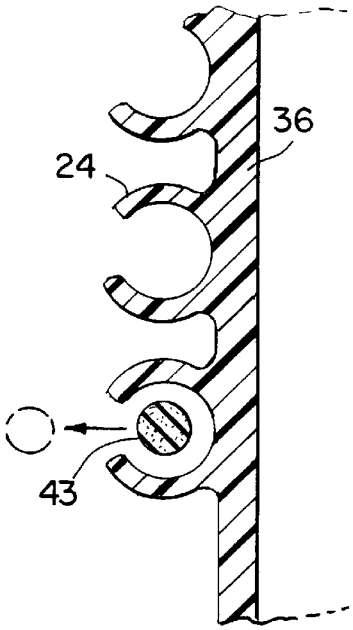
FIG. 8

FLUSH VALVE ATTACHMENT SYSTEM

CROSS-REFERENCE TO RELATED APPLICATIONS (Not applicable)

STATEMENT REGARDING FEDERALLY SPONSORED RESEARCH (Not Applicable)

BACKGROUND OF THE INVENTION

The present invention relates to flush valves that control the outflow of water from a toilet tank. It is especially useful in connection with "one piece" toilets that are constructed wherein there is no easy way to attach the flush valve to the tank after the toilet has been manufactured.

For many one-piece toilets, the underside of the water tank bottom wall is not accessible. This is because a channel from the tank to the toilet bowl and/or a toilet siphon leg is cast directly underneath the tank.

For such toilets, it was therefore more difficult to attach a conventional flush valve to the "blind hole" at the bottom of the tank. (When there is no easy way to reach the underside of the tank bottom wall, it is very difficult to position a nut under the bottom wall, and then thread it onto an end of the valve housing which is below the tank wall.)

The plumbing industry therefore developed flush valve attachment systems which were more suitable for blind outlet holes. In U.S. Pat. No. 4,433,446, there was disclosed a blind attachment system for connecting a flush valve assembly to an outlet in a toilet tank wall. While this system was efficient for some low profile designs, a need still existed for a blind attachment system that could be connected to the vertical wall of the tank.

An advantage of a one-piece toilet with a vertical tank wall connection is the elimination of what is known as a hood plate. This provides the bottom horizontal wall in the tank portion through which flush water passes and a valve mounting surface is provided. In one-piece toilets where the bottom tank wall is below the top of the rim, additional components such as the hood plate must be formed.

Thus, the need exists for an improved flush valve mounting assembly.

BRIEF SUMMARY OF THE INVENTION

In one aspect the invention provides a flush valve attachment system for connecting a flush valve to an essentially vertical wall of a toilet tank. An outlet is formed in the vertical wall of the tank. A flush valve has a housing that extends through the outlet with a radially outwardly extending projection on the exterior side of the wall. The housing is rotatable between a first position in which the projection can pass through the outlet, and a second position where the projection can catch on the exterior side of the wall. An overflow tubular member is in fluid communication with the housing of the flush valve, the overflow tubular member including at least two clip members. The housing has a channel therethrough extending between the overflow tube and the outlet. A flapper valve is connected to at least one of the clip members, the flapper valve constructed and arranged to seat over the channel.

In a preferred form, the flush valve attachment system has a plurality of clip members spaced along the outside of the housing and on a wall of the housing opposite to the channel.

In one aspect, the flush valve attachment system includes a resilient seal bearing against an interior vertical wall of the toilet tank, the seal surrounding the outlet in the wall of the tank and having a central bore aligned therewith.

In another aspect, the housing of the flush valve attachment includes an outlet positioned at essentially 90° with respect to the overflow tubular member.

In yet another aspect, the toilet tank forms a portion of a one-piece toilet which is of the low-profile type.

The objects of the invention therefore include:

a. providing a flush valve assembly of the above kind which can be attached to a blind hole formed in the vertical wall of a toilet tank;

b. providing a flush valve assembly of the above kind which can afford height adjustment for the flapper valve;

C. providing a flush valve assembly of the above kind wherein the valve seat height and the height of the overflow tubular member are easily adjustable through the use of different mold cores;

d. providing a flush valve assembly of the above kind wherein the overflow capacity of the valve is not limited by the configuration of the flapper valve;

e. providing a flush valve assembly of the above kind wherein the overflow tube affords a height adjustment as well as a stop and a guide for the flapper valve;

f. providing a flush valve assembly of the above kind wherein the connection with the vertical wall can be made in a more efficient manner than in prior connections of this type.

BRIEF DESCRIPTION OF THE DRAWINGS

FIG. 1 is a sectional view of a one piece toilet in which has been installed a flush valve assembly embodying the present invention;

FIG. 4 is a sectional view taken along line 4—4 of FIG. 1;

FIG. 5 is a rear view of the overflow tube of the flush valve assembly with a portion of the flapper valve connected thereto;

FIG. 6 is a sectional view taken along line 6—6 of FIG. 5;

FIG. 7 is a view similar to FIG. 5 illustrating the insertion of the flapper valve into one of the slots of the overflow tube;

FIG. 8 is a sectional view taken along line 8—8 of FIG. 7; and

FIG. 9 is a view similar to FIG. 1 except showing a larger flush valve attachment assembly embodying the present invention.

DESCRIPTION OF THE PREFERRED EMBODIMENT

Figure 2:
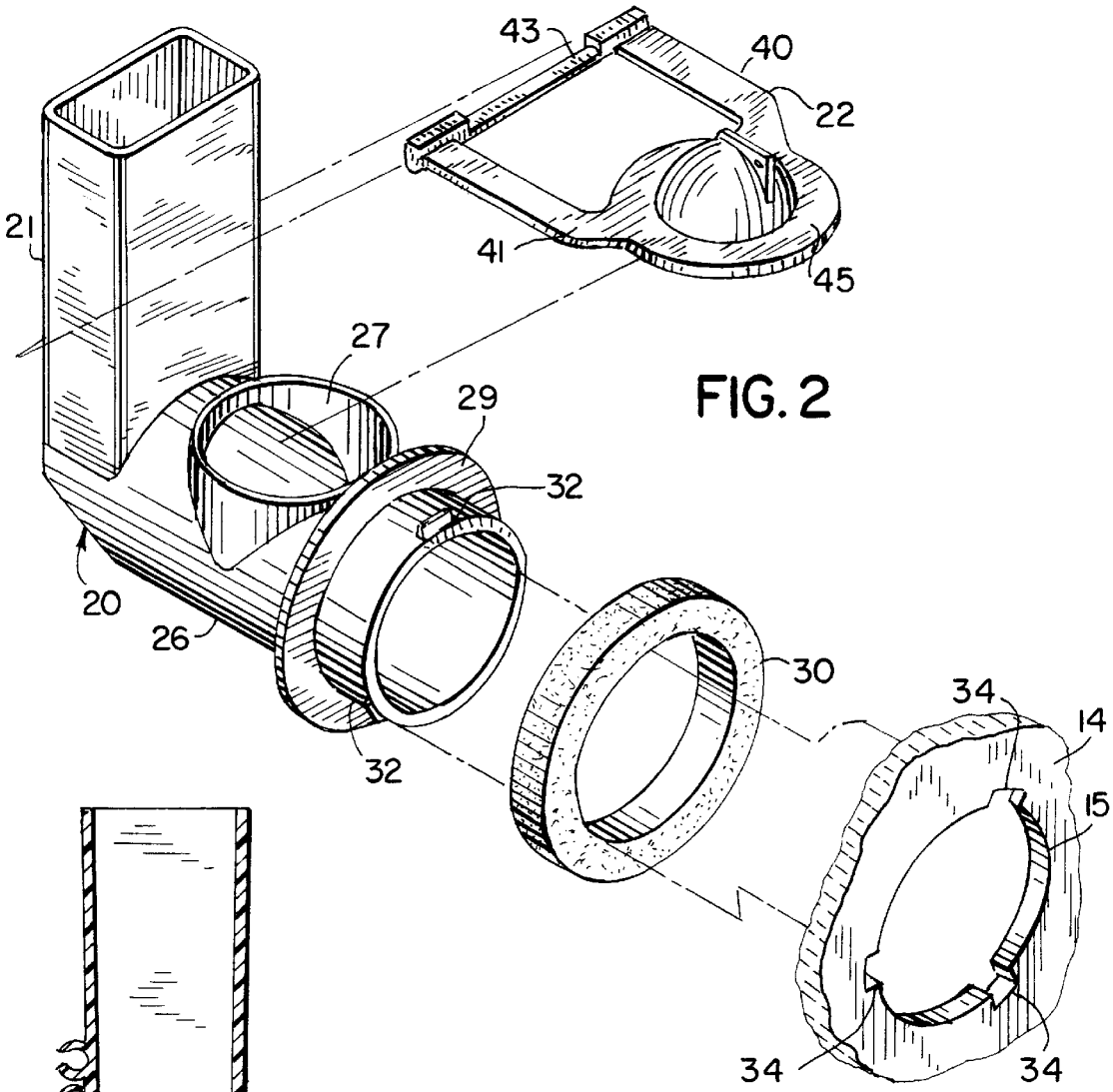
FIG. 2 is an assembly view of the flush valve assembly shown in FIG. 1.

Referring now to FIG. 1 of the drawings, a "one piece" toilet, generally 10, includes a tank portion 11 with a vertical wall 14 having an outlet hole 15 leading to an outlet passage 16. The outlet passage 16 leads into the rim 12 of the one piece toilet.

A flush valve assembly, generally 20 has a an overflow member or tube 21 with a flapper valve 22 connected thereto by the clip members 24. It should be understood that the flapper valve 22 is moved onto and off its seat by one of the many known trip mechanisms (not shown). In this regard, when the tank is to be filled, the flapper valve will be in the position shown in solid lines in FIG. 1, and when the water is to be let out of the tank, the flapper valve will be lifted off its seat as shown in broken lines (through use of a chain attached to the top of the flapper valve).

Figure 3:
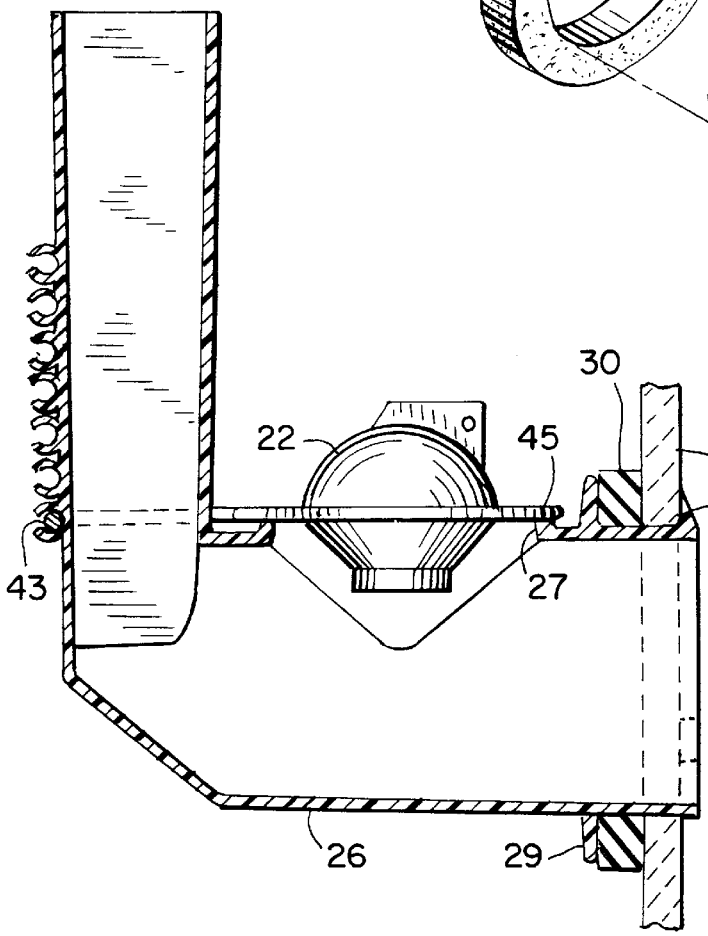
FIG. 3 is an enlarged view in section showing the flush valve assembly connected to a vertical wall of a toilet tank.

Referring now to FIGS. 2–4, the flush valve assembly 20 includes the housing 26 with a cylindrical inlet channel 27, the upper edge of which provides a valve seat for flapper valve 22. Extending from the housing 26 is a flange 29, as well as projections 32. These projections are dimensioned to fit through the keyways 34 in the vertical wall 14.

As best seen in FIG. 4, the keyways 34 are offset from the projections 32 when the flush valve assembly is in the vertical position in the tank portion 11. Accordingly, when it is desired to connect the flush valve assembly, it is tilted so as to align the projections 32 with the keyways 34. The flush valve assembly is then moved inwardly until the projections 32 clear the opposite side of wall 14. At this stage, the flush valve housing is rotated to an upright position which will cause the projections to engage the opposing side of wall 14 with the seal 30 sandwiched between the opposite side of wall 14 and the flange 29. This is seen in FIG. 3.

Referring to FIG. 2 in conjunction with FIGS. 5–8, the attachment of the flapper valve 22 to the back wall 36 of the overflow tube 21 is illustrated. As seen in FIG. 2, the flapper valve 22 has two arm portions 40 and 41 innerconnected with a leg portion 43. The flapper valve 22 in this instance is composed of an elastomeric material. The arm portions 40 and 41 are connected to an essentially flat rim portion 45 which seats and seals on the top of cylindrical channel 27 (see FIG. 3). FIGS. 5 and 6 show the leg portion 43 of the flapper valve in its normal seated position in a clip member 24. In order to position the leg 43 in the clip member 24, it is elongated or stretched such as indicated in FIGS. 7 and 8. This will allow it to pass through the throat of the C-shaped clip member 24.

An alternative embodiment of the flush valve assembly is shown at 10A in FIG. 9. Similar components are designated in this embodiment with numbers similar to those in embodiment 10 except they have an "A" suffix. The difference between the flush valve assemblies is that flush valve assembly 10A has a longer or higher overflow tube 21A, as well as a cylindrical housing extension 50A providing the valve seat for the flapper valve 22A and rim portion 45A. This housing extension 50A is an extension of the cylindrical channel 27 in valve assembly 20. It will be noted that in comparing flush valve assemblies 10 and 10A, they have the same component parts except for the higher overflow tube and the housing extension 50A. This is an important feature of the invention in that the two versions of the flapper valves can be made merely through the adjustment of different mold cores. This allows the valve to be used on one piece toilets having differing tank configurations.

Another advantage is in positioning the clip members 24 on the back side of the overflow tube. Their positioning on the back side has the advantage of using the front side of the overflow tube as a stop, as well as the sides of the overflow tube as a guide for arm portions 40 and 41. This is illustrated in FIGS. 1 and 9.

As stated earlier, the positioning of the flush valve assemblies into a vertical wall obviates the need for the fabrication of a hood plate where the vitreous mounting surface is below the top rim of the toilet.

Another advantage of the vertical mount design keeps the flapper valve cone from interfering with the overflow capacity of the valve. Current flush valves are limited by the flapper cone configuration and not the size of the overflow. The overflow of the vertical mount flush valves dump into a much larger horizontal portion of the valve, and they are therefore only limited by the size of the overflow, not the flapper cone.

Still another important feature of the invention is that the vertical mount flush valve assemblies install into a "keyed" hole rather than a triangular wankel type hole. This allows the vertical valve to use smaller tabs and a smaller gasket or seal. Therefore, a smaller mounting surface is needed.

It will be appreciated that in addition to the specific embodiment shown, the invention can appear in other embodiments. For example, it is not critical that there be a plurality of projections on the valve housing. One or two may suffice. Neither is it necessary that a particular type of flapper valve be employed such as one having a stretchable or elongated leg portion. All that is required is that it be adaptable to being placed in a clip member on the back side of the overflow tube. Thus, there may be various modifications and changes in embodiments which have shown which are within the scope of the invention. Such modifications and changes are meant to be within the scope of the invention. As such, the invention is not limited by the illustrative description above.

I claim:

1. A flush valve attachment system for connecting a flush valve to an essentially vertical wall of a toilet tank the tank having an outlet formed in said wall, the system comprising:

a flush valve having a housing adapted to extend through the outlet with a projection extending radially outwardly from the housing on the exterior side of the wall;

said housing being rotatable between a first position in which the projection can pass through the outlet, and a second position where the projection can catch on the exterior side of the wall;

an overflow tubular member in fluid communication with the housing of the flush valve, the overflow member including at least two vertically spaced clip members;

said housing having a channel therethrough extending between the overflow member and the outlet; and a flapper valve connected to at least one of the clip members, the flapper valve being constructed and arranged to seat over the channel.

2. The flush valve attachment system of claim 1, wherein the clip members are defined by a plurality of clip members vertically spaced along an outside of the overflow member.

3. The flush valve attachment system of claim 2, wherein the clip members are positioned on a wall of the overflow member opposite to the channel.

4. The flush valve attachment system of claim 3, wherein the clip members are essentially C-shaped in configuration.

5. The flush valve attachment system of claim 1, further including a resilient seal adapted for bearing against an interior vertical wall of the toilet tank, the seal adapted for surrounding the outlet in the wall of the tank and having a central bore aligned therewith.

6. The flush valve attachment system of claim 1, wherein the housing includes an outlet positioned at essentially 90° with respect to an inlet of the overflow member.

7. The flush valve attachment system of claim 1, wherein the flapper valve includes a valve sealing portion which is essentially flat in configuration.

8. The flush valve attachment system of claim 1, wherein the toilet tank forms a portion of a toilet having an integral tank and bowl.

9. The flush valve attachment system of claim 1, wherein the flapper valve includes a stretchable leg portion for seating in the clip members.

* * * * *